US012181257B2

(12) United States Patent
Su

(10) Patent No.: US 12,181,257 B2
(45) Date of Patent: Dec. 31, 2024

(54) LONG-RANGE ELECTRIC-PULSE BULLET AND WEAPON

(71) Applicant: Binxin Su, Stockholm (SE)

(72) Inventor: Binxin Su, Stockholm (SE)

( * ) Notice: Subject to any disclaimer, the term of this patent is extended or adjusted under 35 U.S.C. 154(b) by 0 days.

(21) Appl. No.: 18/187,823

(22) Filed: Mar. 22, 2023

(65) Prior Publication Data

US 2024/0085157 A1 Mar. 14, 2024

(30) Foreign Application Priority Data

Apr. 12, 2022 (CN) ..... 202210377854.6

(51) Int. Cl.
*F41H 13/00* (2006.01)

(52) U.S. Cl.
CPC ..... *F41H 13/0031* (2013.01)

(58) Field of Classification Search
CPC ..... F41H 13/0031; F41H 13/0012; F41H 13/0025
See application file for complete search history.

(56) References Cited

U.S. PATENT DOCUMENTS 5,698,815 A * 12/1997 Ragner ..... F41H 13/0006 102/504
6,880,466 B2 * 4/2005 Carman ..... F41H 13/0031 119/908
7,114,450 B1 * 10/2006 Chang ..... F41H 13/0031 361/232
7,327,549 B2 * 2/2008 Smith ..... F41H 13/0025 361/232
7,984,676 B1 * 7/2011 Gavin ..... F41H 13/0031 361/232
8,141,493 B1 * 3/2012 Kuchman ..... F42B 12/66 102/501
9,618,303 B2 * 4/2017 Hensler ..... F41H 13/0031
10,598,467 B1 * 3/2020 McDermit ..... F41A 9/70
11,280,591 B2 * 3/2022 Gallimore ..... F42C 13/006
2003/0094113 A1 * 5/2003 Warnagiris ..... F42B 12/36 102/502
2004/0017178 A1 * 1/2004 Chang ..... H05C 1/06 320/114
2005/0039628 A1 * 2/2005 Carman ..... H05C 1/00 119/908
2005/0073796 A1 * 4/2005 Smith ..... F41H 13/0031 361/232
2005/0188887 A1 * 9/2005 Chang ..... H05C 1/06 102/502
2006/0279898 A1 * 12/2006 Smith ..... F41H 13/0025 361/232

(Continued)

*Primary Examiner* — Joshua E Freeman
(74) *Attorney, Agent, or Firm* — Westbridge IP LLC

(57) ABSTRACT

Disclosed are a long-range electric-pulse bullet and a weapon. The electric-pulse bullet includes a striking module, a circuit module, a connection module and an ejection device. The striking module includes at least a pair of electrodes for launching to a target. The circuit module is for generating a pulse current. The connection module is for electrically connecting the electrodes and the circuit module, and conducting the pulse current to the target through the electrodes. The ejection device is adjacent to the electrodes, and configured to eject and separate the electrodes outwards when the electric-pulse bullet is launched, making a spacing between the electrodes immediately reach at least 100 millimeters.

19 Claims, 6 Drawing Sheets

(56) References Cited

U.S. PATENT DOCUMENTS

| | | | | |
|---|---|---|---|---|
| 2007/0101893 | A1* | 5/2007 | Shalev | F42B 12/36 102/512 |
| 2007/0283834 | A1* | 12/2007 | Chen | F41H 13/0025 102/502 |
| 2010/0101445 | A1* | 4/2010 | Garg | F42B 12/36 102/502 |
| 2010/0275806 | A1* | 11/2010 | Gavin | F41H 13/0031 102/502 |
| 2011/0002077 | A1* | 1/2011 | Brundula | F41H 13/0025 361/232 |
| 2019/0376768 | A1* | 12/2019 | Nerheim | F41H 13/0025 |
| 2021/0080232 | A1* | 3/2021 | Gallimore | F42C 13/006 |
| 2021/0262770 | A1* | 8/2021 | Albayrak | F41H 13/0031 |
| 2022/0034634 | A1* | 2/2022 | Ladyagin | F41H 13/0025 |
| 2022/0082357 | A1* | 3/2022 | Smith | F41H 13/0025 |

* cited by examiner

LONG-RANGE ELECTRIC-PULSE BULLET AND WEAPON

CROSS-REFERENCE TO RELATED APPLICATIONS

This application claims priority to Chinese Patent Application No. 202210377854.6, filed on Apr. 12, 2022, the entire contents of which are incorporated herein by reference.

TECHNICAL FIELD

The present disclosure relates to the technical field of electronic pulse weapons, in particular to a long-range electric-pulse bullet and a weapon.

BACKGROUND

The electronic pulse weapon is an effective anti-terrorism and anti-riot electronic device. It has been widely used in military, police, security and other law enforcement departments at home and abroad. At present, the appearance and size of a common traditional electronic pulse weapon product are similar to that of a pistol. The structure mainly includes two parts: the main body and the cartridge. The circuit module is provided in the main body to generate pulse current. The cartridge is generally a disposable consumable device, which can be detachably installed in the front of the main body. The cartridge includes a launching assembly and a power assembly. The launching assembly includes at least a pair of electrodes with opposite polarity. The electrodes are connected to the circuit module through wires, and the power assembly is used to launch the electrodes to a remote target.

When in use, the operator pulls the trigger on the main body of the electronic pulse weapon, and the power assembly in the magazine are excited, resulting in the instantaneous release of high-pressure gas, and the two electrodes are launched outside the cartridge. When the electrodes hit the remote target, the circuit module in the main body transmits the current to the target through wires, resulting in the tonic contraction of the whole body muscles and the loss of autonomous activity, thereby controlling the target.

A large number of authoritative research and practical statistical data show that when the two electrodes of the electronic pulse weapon hit the target, the spacing between the electrodes needs to be at least 100 millimeters, so that the pulse current can pass through enough tissues and organs to form a current circuit, so as to achieve a satisfactory control effect. In order to reach this goal, the two electrodes in the cartridge of electronic pulse weapon are usually set with a launch angle of 5 degrees to 8 degrees, so as to separate the electrodes from each other after launch and reach the required separation distance before hitting the target, to ensure the subduing effect. Theoretically, the larger the spacing distance between electrodes, the wider the tissues involved, the more obvious the effect. On the other hand, if the spacing distance between electrodes is too large, at least one electrode will miss the target, thus losing the functional effect.

In order to meet the needs of actual combat, the structural design of the main body and magazine of traditional electronic pulse weapons requires light, convenient and compact, so it can be easily carried and hid. In addition to the launching assembly and power assembly inside the cartridge of the electronic pulse weapons, the cartridge also accommodates wires for conducting the current. The range of traditional electronic pulse weapons is generally 5-10 meters, so it is necessary to store wires of corresponding length in the cartridge; In addition, because of the powering structure of electronic pulse weapon requires insulation and is usually made of plastic materials, its ability to withstand kinetic energy impact is very limited, so the propellant power provided by its power system for launching the electrodes is also limited, which limits the shooting range and application scope of such products.

In recent years, a new type of electric-pulse bullet has emerged, such as the eXtended Range Electronic Projectile (XREP) developed by Taser international. When being launched, the electric-pulse bullet is self-contained, and the bullet itself contains circuit modules for generating pulse current, electrodes and other electronic components. Because it carries the circuit module system itself, the bullet does not need long wire connecting electrodes and the circuit module in the cartridge as in the traditional electronic weapon, so it is also called wireless electric-pulse bullet or wireless bullet. This type of electric-pulse bullet lacks the powering components in the cartridge of the traditional electronic pulse weapon, so it needs to be launched using another separate launching device, such as an anti-riot shotgun. This kind of launching device can use more powerful propellant power, which greatly increases the range of the electric-pulse bullet, up to about 30 meters.

The Taser XREP is mainly composed of torsion spring tail, electronic pulse generator, front main electrodes and Jolia cactus-thorn auxiliary electrodes. The torsion spring tail assembly unfolds after XREP leaves the cavity of the launcher, forcing the bullet body to start rotating, so that XREP can fly forward stably. The electronic pulse generator includes an integrated circuit module board and a power supply system to generate electric pulse current for controlling a target. The front main electrodes refers to the four electrodes with barbed needle in front of the main body of the bullet, which is mainly used to puncture the target and fix the electrodes on the target body. The front main electrodes are combined with other parts of the electric-pulse bullet in structure and during flight, and is separated from the main body when the electrodes strikes the target. The connecting wire between them keeps the main body of the bullet carrying the circuit module hang on the surface of the human body. At the same time, the six Jolia cactus-thorn electrodes on the main body are automatically unfolded, in order to obtain a larger spacing between the front main electrodes and the auxiliary electrodes to enhance the functional effect.

The above electric pulse bullet device mainly has the following technical defects: 1. The fixed spacing between the four main electrodes in the front of the bullet body is only 8-15 millimeters, which is far from reaching the minimum 100 millimeters required for completely controlling the target. In addition, it is difficult for the naturally falling Jolia cactus-thorn auxiliary electrodes to effectively penetrate the target body, as they lack the energy needed, especially when the target is heavily dressed; so the structural design attempting to increase the spacing between the main electrode and the auxiliary electrodes, and hence to increase the functional effects is not ideal; 2. The function of the torsion spring tail at the rear of XREP is to promote the bullet body to rotate after launching to maintain its flight stability. However, the rotating bullet will also cause the main electrodes in the front to rotate with it, and when the electrodes contacts the target, the torsion generated by its own rotation will affect the electrodes to effectively puncture the target, causing the electric-pulse bullet to easily falling off from the target; 3. The diameter and cross-section of the solid structure of the main electrode in the front of the XREP is significantly larger than that of the traditional wired electronic pulse weapon, and the weight of the bullet as a whole increases greatly, resulting in the increased influence of flight drag and gravity. The above technical defects affect the functional effect, range and accuracy of the electric-pulse bullet.

SUMMARY

The present disclosure provides an electric-pulse bullet and a weapon, which aims to solve the technical defects of the prior art products.

In order to achieve the above purpose, the present disclosure provides an electric-pulse bullet, including:

- a striking module, including at least a pair of electrodes for launching to a target;
- a circuit module for generating pulsed current;
- a connection module for electrically connecting the electrodes and the circuit module, and conducting the pulse current to the target through the electrodes; and
- an ejection device adjacent to the electrodes, and configured to eject and separate the electrodes outwards when the electric-pulse bullet is launched, making a spacing between the electrodes immediately reach at least 100 millimeters.

In an embodiment, the spacing between the electrodes after being ejected and separated is greater than that before being ejected and separated.

In an embodiment, the spacing between the electrodes, after being ejected and separated, is 100-600 millimeters.

In an embodiment, the connection module includes at least one section of flexible wire body.

In an embodiment, the wire body is a conductor.

In an embodiment, the circuit module includes a switch, and the switch is turned on after the electric-pulse bullet is launched, to make the circuit module work and generate pulse current.

In an embodiment, the striking module includes an elastic frame, and the elastic frame is arranged on the electrodes.

In an embodiment, the elastic frame maintains the spacing between the electrodes at a preset length of 100-600 millimeters after the electrodes are ejected and separated.

The present disclosure also provides a weapon, including the electric-pulse bullet as described above.

The present disclosure further provides a dynamic structure of an electric-pulse bullet, including:

- a striking module, including at least a pair of electrodes, a spacing of the electrodes being at least 100 millimeters;
- a circuit module, which lags behind the electrodes; and
- a connection module, connecting the electrodes and the circuit module respectively,
- the connection module is stretched and in a tight state under lagging flight action of the circuit module and acts on the electrodes, making the electrode always fly in an attitude with a head facing forward, and limit excessive separation of the electrodes.

Compared with the rigidity and integrated structure of the electric-pulse bullet in the prior art, the present disclosure provides different technical solutions and adopts different structural configuration and distribution, including: split launching, flexible connection, and linear extension structure distribution. The Taser XREP electric-pulse bullet in the prior art is taken as an example. Compared with the technical scheme of the present disclosure, the former's structural form and spacing of the electrodes before and after launching remain unchanged, and fly as an integral whole unit with circuits and other components. While with the electric-pulse bullet having the technical characteristics of the present disclosure, the electrodes 21 of the striking module 20 are ejected outwards and separated from each other, and the spacing between the electrodes reaches at least 100 millimeters instantaneously. In addition, the striking module 20 and the circuit module 40 are also separated from each other to form a relatively independent flight unit. The structural parts of the former is rigid combination, while for the latter, the striking module 20 and the circuit module 40 are connected by a connection module 50 with flexible characteristics, even the striking module 20 or the circuit module 40 itself could be the flexible structure arrangement, so that the overall structure of the electric-pulse bullet 100 has flexible characteristics. The overall geometric length of the former structure is only 60-75CM, while the latter is 200-700 millimeters linear chain extension distribution, forming a dynamic and orderly arrangement among the structures of striking module, connection module and circuit module.

The split launching mechanism with the technical features of the present disclosure can significantly reduce the volume and weight of each independent structural part, and effectively reduce power consumption and wind drag. The flexible structure adopted in the present disclosure is a new field actively explored and studied by many countries nowadays (such as flexible wing). Compared with the rigid structure, the flexible structure has self-adaptability, which can achieve the active adjustment of structural form, reduce power consumption and to obtain the best aerodynamic characteristics according to the aerodynamic force condition. The linear extended structure distribution makes the force acting point moving backward significantly, and the lever power arm is extended, which makes it easier to achieve dynamic balance and stability under the same mass conditions.

The above structural features can reduce the body weight of the electric-pulse bullet, reduce its aerodynamic resistance during flight, enhance its structural balance and flight stability, achieve the dynamic and orderly arrangement of various functional components, keep the electrodes always flying in the correct attitude with the head facing forward, limit the excessive separation between the electrodes and maintain the spacing between the electrodes in the range of 100-600 millimeters, which is conducive to improving the range and accuracy of the electric-pulse bullet, and improving the target striking ability and functional effect.

BRIEF DESCRIPTION OF THE DRAWINGS

In order to more clearly illustrate the technical scheme and features of the present disclosure, several embodiments are briefly described and introduced with the attached drawings. It is obvious that the following description is only a few specific embodiments of the present disclosure and has no intention to limit its technical field and scope.

The realization of the object, functional features and advantages of the present disclosure will be further described with reference to the attached drawings in combination with the embodiment.

DETAILED DESCRIPTION OF THE EMBODIMENTS

The technical scheme in the embodiment of the present disclosure will be clearly and completely described below in combination with the accompanying drawings. Obviously, the described embodiment is only a part of the embodiment of the present disclosure, not the whole content. Based on the embodiments of the present disclosure, all other embodiments obtained by ordinary technicians in the art without creative work belong to the protection scope of the present disclosure.

It should be noted that if the embodiment of the present disclosure involves directional indication (such as up, down, left, right, front, rear . . . ), the directional indication is only used to explain the relative position relationship and movement between components in a specific attitude (as shown in the attached figure). If the specific attitude changes, the directional indication will change accordingly.

In addition, if there is a description of "first", "second" and the like in the embodiment of the present disclosure, the description of "first", "second" and the like is only for descriptive purposes, and cannot be understood as indicating or implying its relative importance or implicitly indicating the number of indicated technical features. Thus, the features defining "first" and "second" may include at least one of the features explicitly or implicitly. In addition, the technical solutions between various embodiments can be combined with each other, but it must be based on the realization of ordinary technicians in the art. When the combination of technical solutions is contradictory or impossible, it should be considered that the combination of technical solutions does not exist and is not within the protection scope of the present disclosure.

Figure 1:
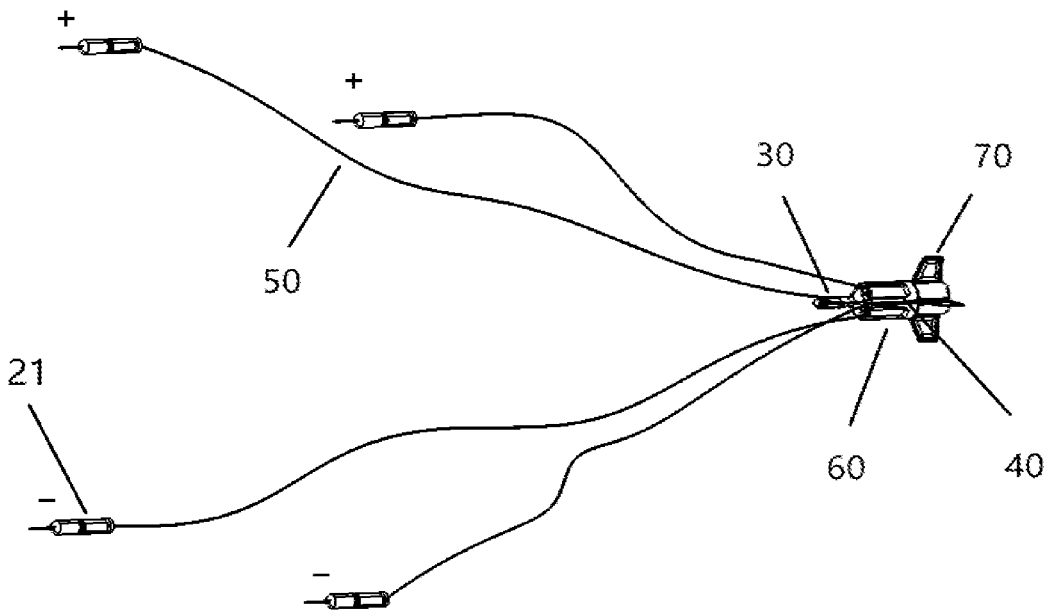
FIG. 1 is a schematic diagram of the dynamic structure of the electric-pulse bullet according to an embodiment of the present disclosure during flight.
Figure 2:
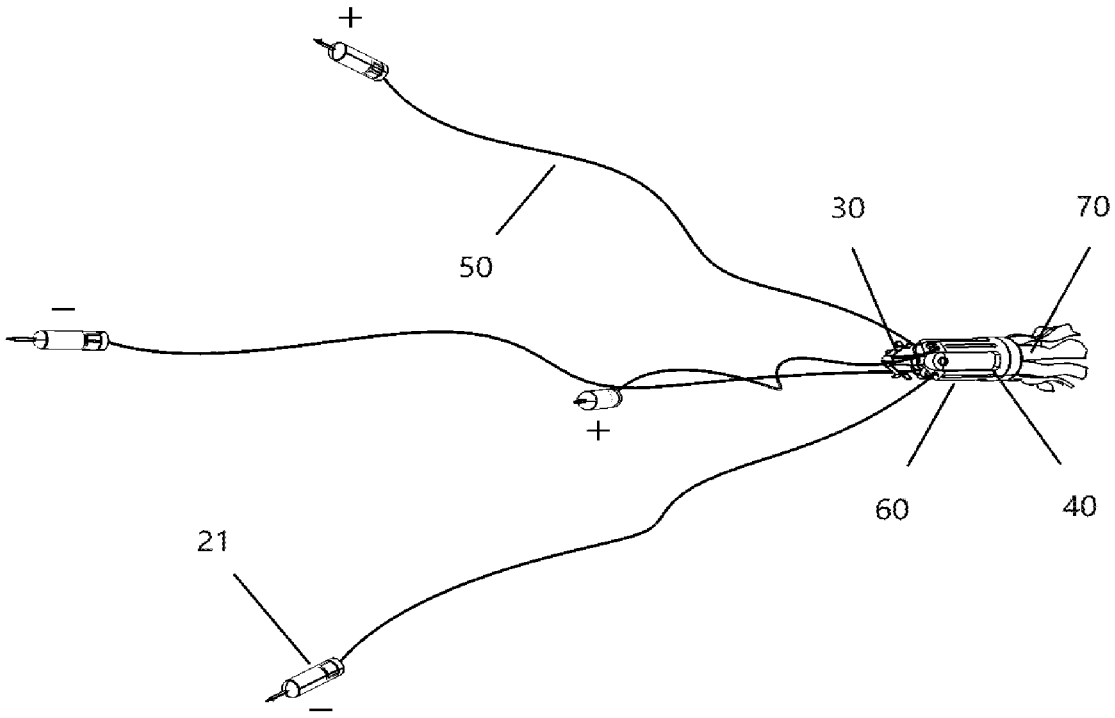
FIG. 2 is a schematic diagram of the dynamic structure of the electric-pulse bullet according to another embodiment of the present disclosure during flight.
Figure 3:
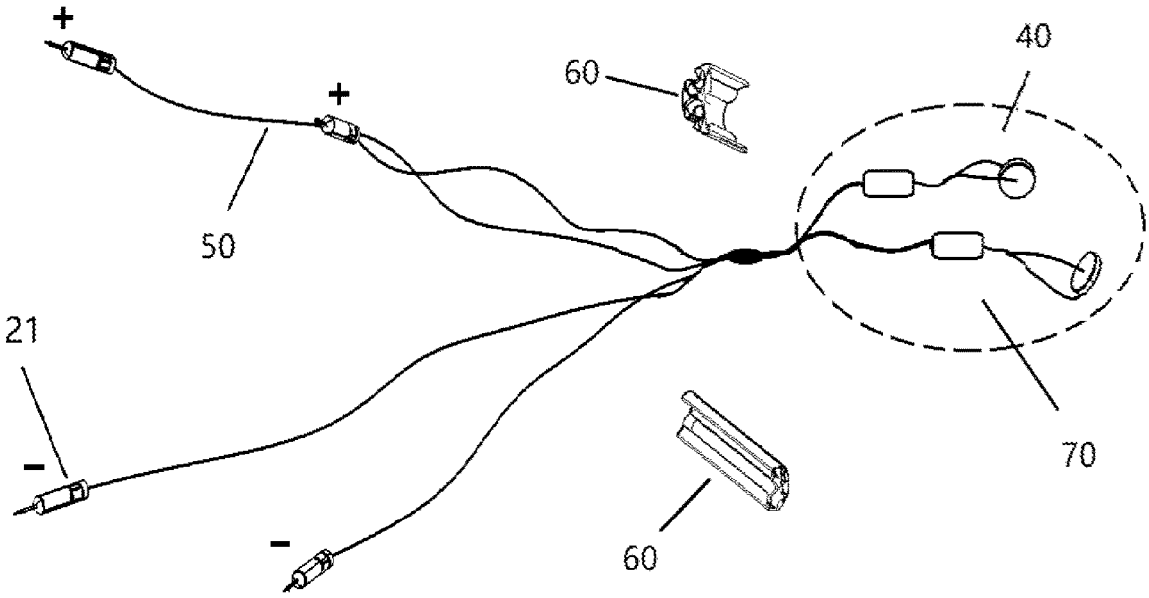
FIG. 3 is a schematic diagram of the dynamic structure of the electric-pulse bullet according to yet another embodiment of the present disclosure during flight.

As shown in FIG. 1, FIG. 2 and FIG. 3, which are the dynamic structure diagram of the electric-pulse bullet 100 in the flight process according to three embodiments of the present disclosure. During the dynamic flying, the separation spacing between the electrodes 21 in the striking module 20 is at least 100 millimeters, which is the recognized minimum spacing required to effectively control the target. The circuit module 40 is set to fly lag-behind the striking module 20. The connection module 50 includes at least one section of wire body 51, which connects each electrode 21 and circuit module 40 respectively, and is stretched and in a relatively tight state under the action of lagging flight of the circuit module 40, which has a restraining effect on both the electrode 21 and circuit module 40, thus controlling the flight attitude of the electrode 21, and limiting the excessive separation of the spacing between the electrodes 21, keeping the electrode 21 always with the head forward posture, and maintaining the spacing between the electrodes 21 in the range of 100-600 millimeters, thus to form an orderly arrangement and dynamic balance and stability among the structures of the striking module 20, the connection module 50 and the circuit module 40.

The striking module 20 and the circuit module 40 are arranged in the shell 11 of a cartridge 10 before launching. The spacing between the electrodes 21 of the striking module 20 is only 5-15 millimeters, and the circuit module 40 can be accommodated in a receiving device 60. The above structure arrangement and the spacing of the electrodes are similar to the prior art. However, different from the prior art, the former's structural form and spacing of the electrodes after launching remain unchanged, and fly as an integral whole unit with circuits and other components, while with the electric-pulse bullet having the technical characteristics of the present disclosure, each electrode 21 of the striking module 20 is ejected outwards and separated from each other after launching, and the spacing between the electrodes 21 reaches at least 100 millimeters instantaneously. In addition, the striking module 20 and the circuit module 40 are also separated from each other to form a relatively independent flight unit.

During dynamic flight, if there is no restriction on the electrodes 21, each electrode 21 will continue to fly along the initial ejection angle and expand outward, and the spacing between the electrodes 21 will be larger and larger. In addition, due to the lack of self-stability mechanism, such as self-rotation or balancing tail, the electrode 21 will self-rolling during flight. The above phenomenon will lead to the excessive spacing of the electrode 21 and fly off the long-range target, as well as inability to keep the head of the electrode 21 facing forward to hit the target. Similarly, the unconstrained circuit module 40 will also be in a disordered flight state, resulting in rollover, deviation from the flight trajectory and other phenomena due to its own instability and other factors.

The technical scheme proposed by the present disclosure includes a connection module 50 for connecting the striking module 20 and the circuit module 40. The connecting module 50 includes at least one section of wire body 51. In an embodiment, the diameter of the wire body 51 is 0.3-30 millimeters and the length is 50-500 millimeters. The wire body 51 is a flexible structure and can be bent arbitrarily under stress. The wire body 51 can be made of a pure metal conductor, such as insulated copper wire, or a combination of conductor and nonconductor, such as winding and wrapping metal wire and Kevlar fiber. It can also be nonconductor, with its surface coated with conductive substances such as conductive adhesive to make it conductive, the latter two can significantly increase the toughness and strength of the wire body 51 structure, making it more resistant to impact and tension. One end of the wire body 51 is connected to the output end of the circuit module 40, and the other end of the wire body 51 is connected to the rear 23 of the electrode 21.

The connection module 50 mainly plays the following roles in the dynamic structure of the electric-pulse bullet 100: a. the wire 51 of the connection module 50 has conductive component, and the pulse current generated by the circuit module 40 of the electric-pulse bullet 100 is transmitted to the electrode 21 through the wire 51, and then play a function role through the target; b. The wire body 51 is stretched and in a relatively tight state under the lagging flight action of the circuit module 40; by pulling the rear 23 of the electrode 21 to control its flight attitude, keeping the front 22 of the electrode 21 always with its head flying forward to avoid rocking and rolling in flight, which is conducive to effectively puncture the target body when the needle body 24 at the head of the electrode 21 contacts the target; c. The pulling of the wire body 51 on the electrodes 21 can curb their excessive separation from each other, and maintain the spacing of the electrode 21 within a reasonable range relative to the size of the target body. In an embodiment, the range is 100 millimeters to 600 millimeters to effectively hit the target; d. The pulling effect of the wire body 51 on the circuit module 40 also helps to keep its front end flying forward and curb or reduce its tumbling.

In this embodiment, the external shape of the electrode 21 is an elongated column, including the front 22 and the rear 23, the front 22 includes a needle body 24, and the head of the needle body 24 is provided with a barb to puncture the superficial tissue of the target body skin and fix the electrode 21 on the target. The structure of the front part 22 of the electrode 21 adopts materials with high specific gravity, such as metal lead, and the rear part 23 adopts materials with light specific gravity, such as metal copper, stainless steel, aluminum alloy and even plastic, so that the front part 22 of the electrode on the side with large specific gravity can more easily maintain the posture of head facing forward under the pulling action of the wire body 51. In the embodiment of the present disclosure, the electric-pulse bullet 100 includes two pairs (4) of electrodes 21. In practice, when any pair of electrodes 21 with opposite polarity hits the target, the current can form a circuit through the target to achieve the controlling purpose, so as to increase the probability of hitting the target. The positive and negative polarities of the electrodes 21 can be arranged adjacent or opposite to each other. In this embodiment, it is opposite setting. This setting can make full use of the feature that the diagonal distance of the rectangle is greater than the distance between its two adjacent edges to maximize the spacing between the positive and negative electrodes 21.

The circuit module 40 of the electric-pulse bullet includes at least a circuit to generate pulse current. This kind of circuit 40 is mostly described in the literature and will not be introduced in detail herein. It mainly includes power supply, electronic chip, excitation switch, etc. In this embodiment, when the circuit module 40 is located in the cartridge 10, it is in a dormant or non-excited state, and the circuit module 40 does not work. However, when the electric-pulse bullet 100 is launched from the cartridge 10 and the barrel of the launching device, the excitation switch of the circuit module 40 is turned on, and the circuit module 40 starts to work and generates pulse current.

During the dynamic flight, the circuit module 40 lags behind the striking module 20, so that the wire body 51 of the connection module 50 is stretched and in a relatively tight state, which has a containing and restraining effect on the electrode 21 and the circuit module 40 itself. This effect is one of the necessary conditions for the dynamic structure of the electric-pulse bullet 100 of the present disclosure to achieve linear and orderly arrangement, balance, and stability. The lagging flight of the circuit module 40 can be realized in various ways, one of which is to increase the dynamic wind drag of the rear structure of the electric-pulse bullet 100. As shown in the embodiments of FIG. 1 and FIG. 2, the circuit module 40 is arranged inside a receiving device 60, and the diameter and cross-section of the receiving device 60 are greater than that of the electrode 21, and the wind resistance encountered by the receiving device 60 after launch is also greater than the wind resistance encountered by the electrode 21. Therefore, the flight speed is slower than the electrode 21 and lags behind, and is separated from the electrode 21. The casing 61 of the receiving device 60 can be provided with an aperture as needed to reduce and adjust the wind drag. As shown in the figure, the air inlet 65 located in front of the receiving device 60 and the air vent slot 66 on the side wall can be adjusted by changing the aperture size, so as to obtain the best dynamic balance effect of the overall structure.

In the embodiments of FIG. 1 and FIG. 2, the receiving device 60 forms a part of the electric-pulse bullet 100 in flight. The embodiment of FIG. 1 includes a balancing device 70, which is a balance tail. Different from the prior art, the balance tail in the embodiment of the present disclosure will not cause the main body of the electric-pulse bullet 100 to rotate, therefore, it avoids the circular motion of the prior art electrode around the central axis of the bullet body when flying, and the deflection torque of the electrode when hitting the target, which affects the ability to penetrate the target body and even causes it to fall off. The balancing device 70 in the embodiment of FIG. 2 is a group of streamers, which can be made of soft and thin materials such as plastic film, with its one end is connected and fixed to the rear end of the receiving device 60, and the rest can be divided into a plurality of strips. The strips can be arranged inside the receiving device 60 when the electric-pulse bullet 100 is in a static state and is not launched, and can be expanded after launching and to start to play its role. Compared with the balance tail in FIG. 1, the streamer in FIG. 2 has lighter texture and simpler structure. In addition, the effect is more obvious because the balance action point of the latter moves backward and the lever power arm is extended. Of course, other methods can also be adopted, such as the elastic sheet device connected to the tail of the receiving device 60. The structure plays a role in fan-shaped expansion after launch, and there is no intention to limit its scope here.

In the embodiment of FIG. 3, the receiving device 60 is separated from other structures of the electric-pulse bullet 100 after launch and loses its function. At this time, the rear structure of the electric-pulse bullet 100 is only the circuit module 40 itself, which can reduce the mass of the structure and eliminate the dynamic wind resistance caused by the receiving device 60 itself. FIG. 3 is a schematic diagram of the circuit module 40 in the dotted line box, indicating that the components of the circuit module 40 are arranged in a linear extension mode. In an embodiment, the components or parts are connected by wires or non-conductive thread with flexible characteristics, so that the circuit module 40 has flexible characteristics as a whole. The linear length of the structure of the circuit module 40 is significantly longer than that when it is arranged inside the receiving device 60. At this time, the circuit module 40 itself is also the balancing device 70. Although the mass of this section of the structure is reduced compared with that in FIG. 1 and FIG. 2, with the help of the backward movement of the structural dynamic action point and the obvious extension of the lever power arm, it can still rely on its own mass restraint and wind resistance generated by dynamic swing, to effectively play the role of balance and stability. Of course, if necessary, other structures, such as the above streamer, can be added to the linear arrangement structure chain of the circuit module 40 to increase the balance and stability effect.

The function of the balancing device 70 is to further enhance the balance and stability of the receiving device 60 and/or the circuit module 40, so as to maintain the linear flight attitude with the head end facing forward. Secondly, the balancing device 70 itself can also increase the dynamic wind drag of the rear structure of the electric pulse bullet 100, causing the circuit module 40 to fly lag-behind the striking module 20. The balancing device 70 may function as a single structure, such as a balancing tail or the circuit module 40 itself. It can also be a combination of any suitable structure, such as the receiving device 60 and the balance tail or streamer, or the circuit module 40 and the above streamer, or even a combination with other structures such as the filler 14. The advantage of using the solid structure of the electric pulse bullet 100 itself to bear the balance device 70 is that when it is launched, the solid structure will fly together with the main structures of the electric pulse bullet 100, so it will not hurt others due to falling off and splashing after coming out of the bore.

Figure 4:
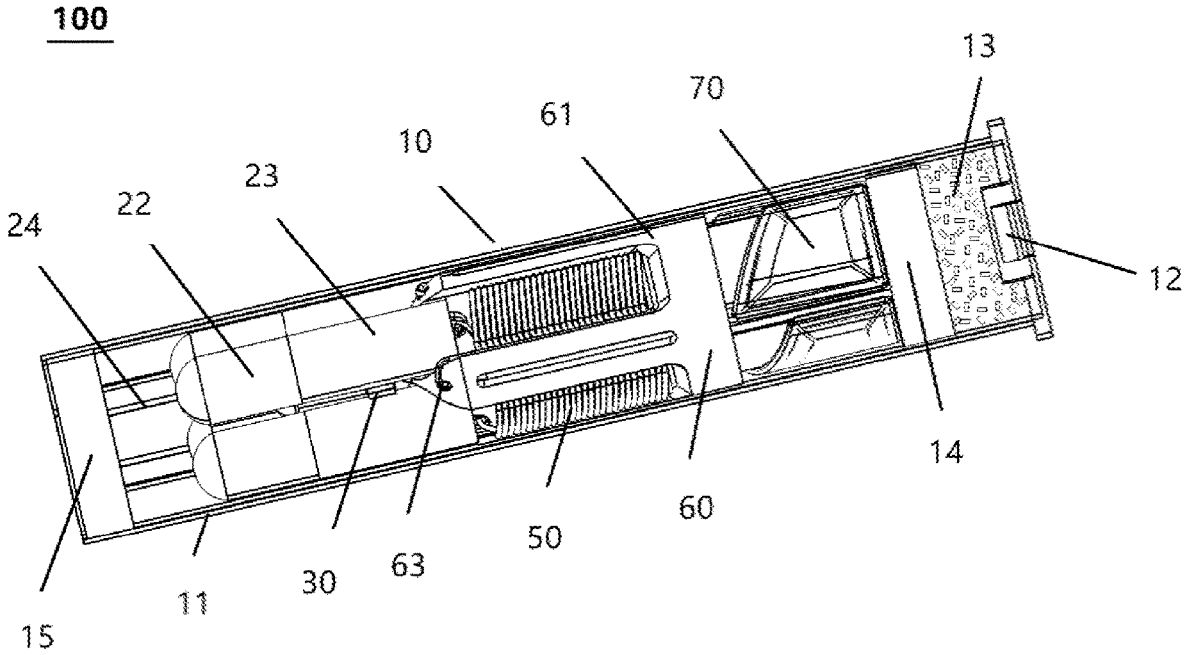
FIG. 4 is a schematic diagram of the overall basic structure of the electric-pulse bullet according to an embodiment of the present disclosure.

As shown in FIG. 4, FIG. 4 is the overall structure diagram according to an embodiment of the present disclosure. As shown in the figure, the electric-pulse bullet 100 includes a hollow cartridge 10, a striking module 20, a circuit module 40, a connecting module 50, an ejection device 30, and a receiving device 60. The cartridge 10 includes a shell 11, primer 12, propellant 13, filler 14, or the like. The auxiliary structures such as the ejection device 30 and the receiving device 60 are arranged inside the shell 11 of the cartridge 10. When in the static state, the ejection device 30 is arranged adjacent to the electrode 21 of the striking module 20, to eject and separate the electrode 21 after the electric-pulse bullet 100 is launched, so that the spacing between the electrodes can reach at least 100 millimeters instantaneously. The electric-pulse bullet 100 in this embodiment also includes a balance tail 70, which is in a folded state inside the shell 10. After launching, it will automatically unfold by the elastic reset of its own structure. In an embodiment, a front cover 15 can be arranged at the front end of the cartridge 10, to seal and protect the contents inside the cartridge 10. The filler 14 herein includes at least one piston. One function of the piston is to seal and isolate the propellant 13 and other components from each other, and protect the propellant 13 from moisture and so on. Another important function of the piston is to generate high pressure inside the cartridge 10 in a closed state when the propellant 13 is ignited, so as to increase the chamber pressure of the launching device, thus to effectively increase the dynamic initial launch velocity and range of the electric pulse bullet 100. The material of the piston can be diverse, such as hard rubber, plastic, etc. Its structural characteristics can be elastomer, which is forced into the shell 11 by its own elastic deformation, or a rigid body, adding air-sealing loop, sealing snap ring, or the like, in the structure to achieve the sealing effect. The piston is made of materials with light specific gravity, such as cork or foam material, so that it will not cause serious injury to others when it is separated from the bullet body after launch. The piston can also be combined or connected with other components to fly together, such as flexibly connected with the receiving device 60 or the circuit module 40 and playing the role of the balancing device 70.

The electric-pulse bullet 100 can be launched with a conventional military and police shotgun. For example, it can be fired with a No. 12 caliber shotgun, and can be used for single shot or continuous shot according to the structure of the launcher. In practice, when the operator pulls the trigger, the primer 12 of the electric-pulse bullet 100 is excited and ignited, which then detonates the propellant 13 and instantly generates high-pressure gas, to push the filler 14 and other structures in the cartridge 10 to break through the front cover 15, and then launched out of the chamber of the shotgun.

Figure 5:
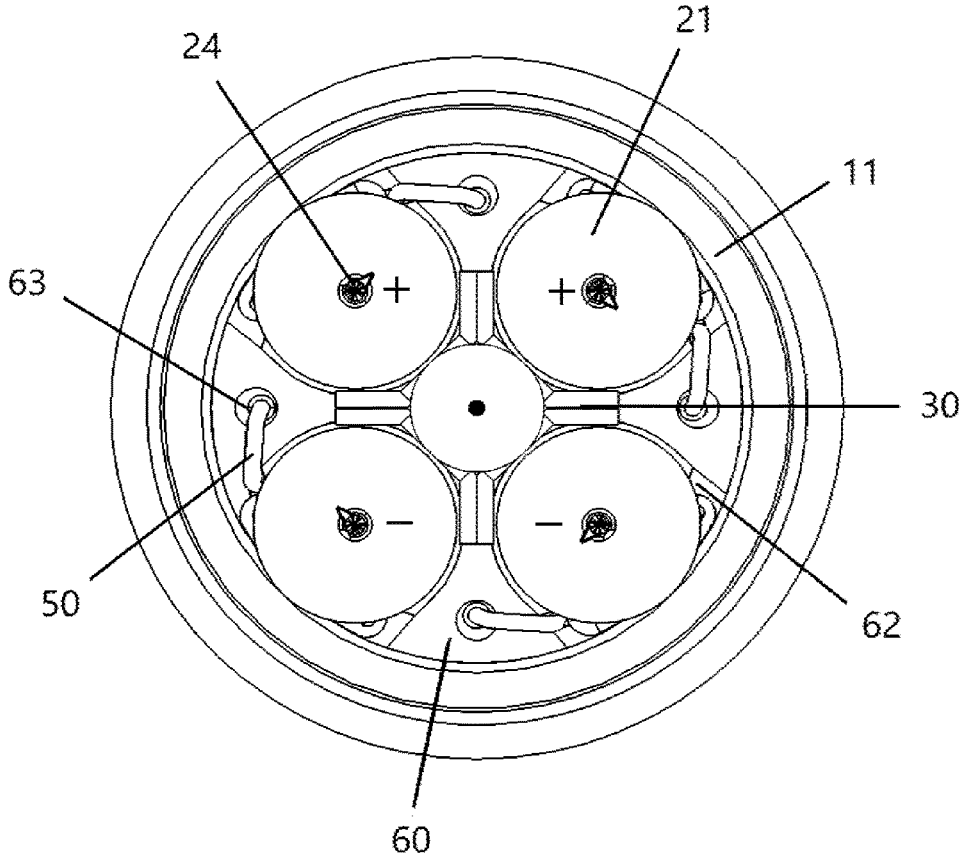
FIG. 5 is a schematic diagram of the front view of the electric-pulse bullet structure in FIG. 3.

As shown in FIG. 5, FIG. 5 is a front view of the structural distribution of the electric-pulse bullet 100 located in the cartridge 10 in FIG. 4. As shown in the figure, the front cover 15 has been removed. It can be seen that the four electrodes 21 of the striking module 20 are evenly distributed in the shell 11 of the cartridge 10, and are in the upright pre-launch position with the puncture needle body 24 facing forward. In this embodiment, the ejection device 30 is a spring-sheet device, which is located on the inner side of the electrodes 21 and is in an elastic compression state, so as to eject and separate the electrodes 21 towards the outer periphery by its elastic reset function after the electric-pulse bullet 100 is launched. It can also be seen in the figure that a part of the casing 61 of the receiving device 60, and the wire hole 63 on the casing 61 for the wire body 51 connecting the circuit module 40 to pass through.

Figure 6:
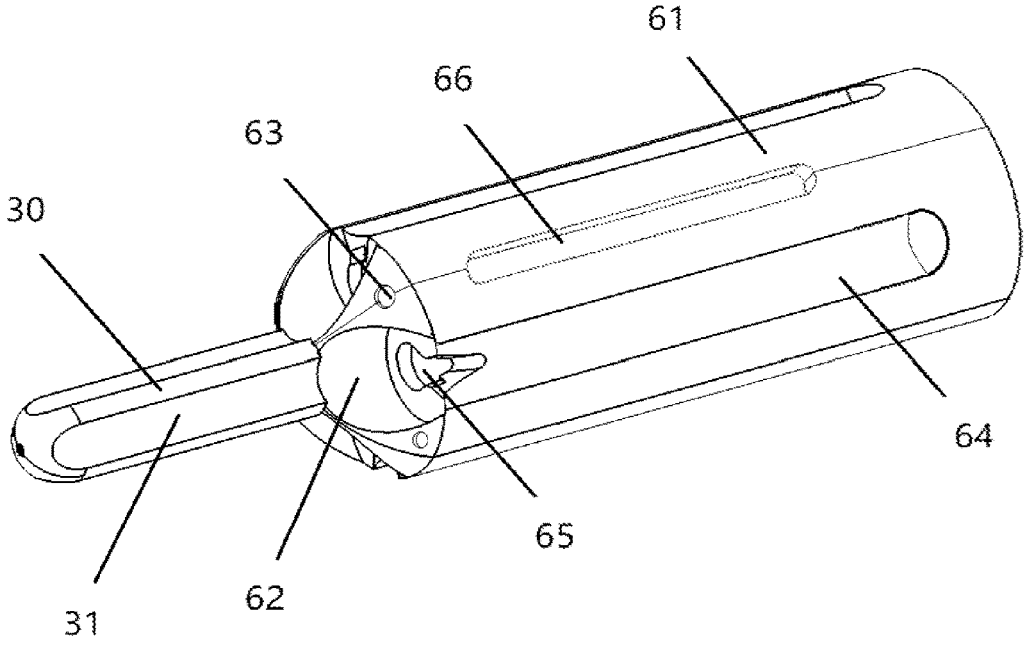
FIG. 6 to FIG. 9 are the structural diagram of the receiving device of the electric-pulse bullet according to some embodiments of the present disclosure.
Figure 7:
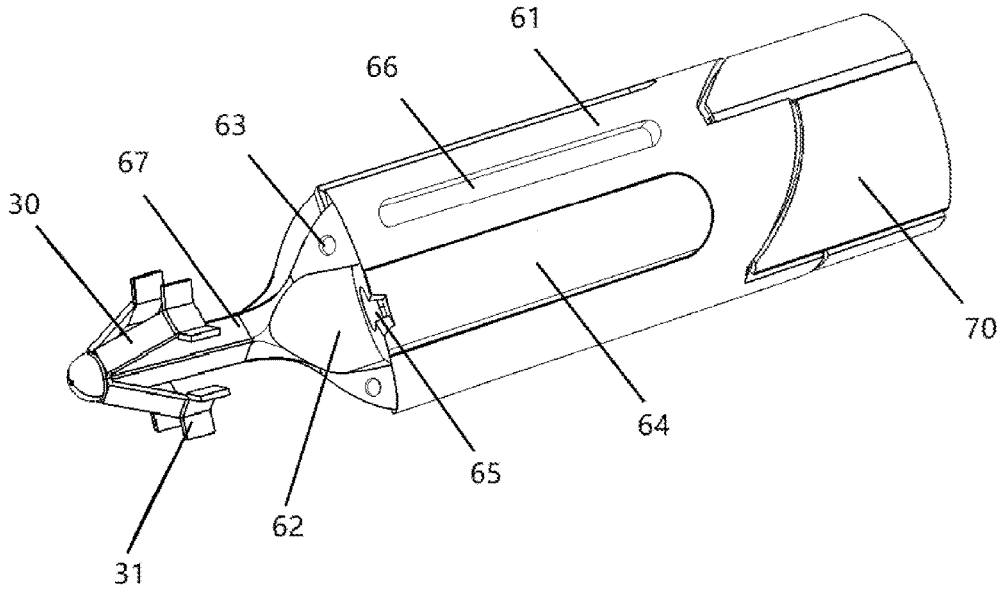
Figure 8:
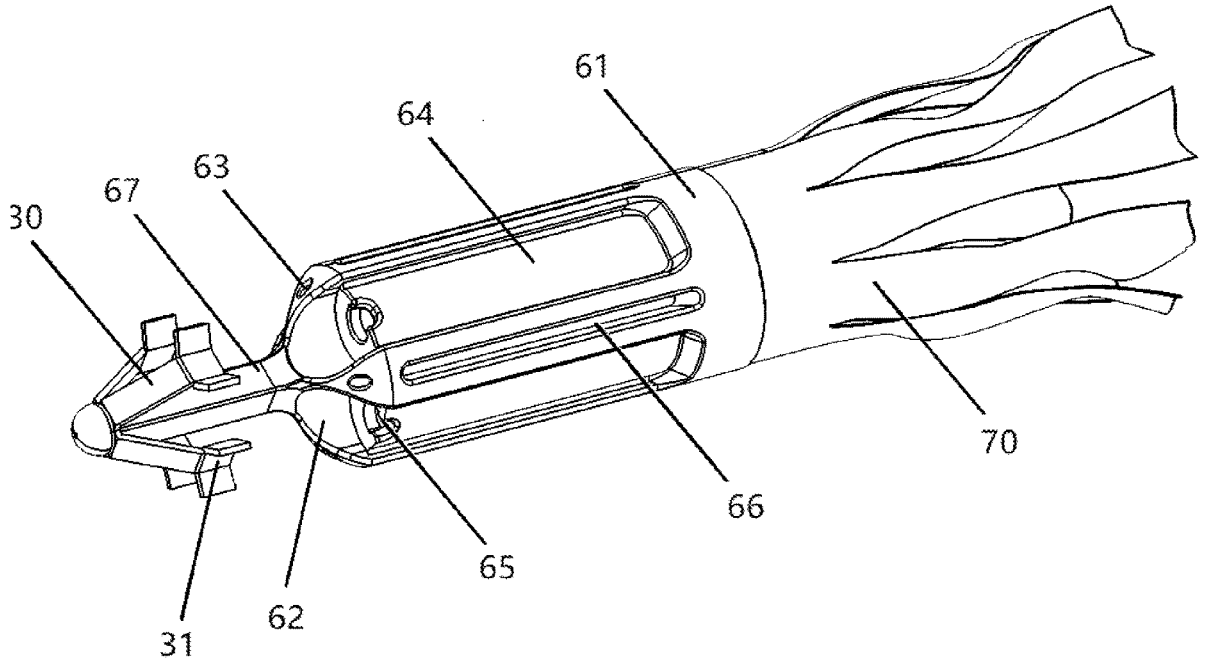

As shown in FIG. 6 to FIG. 9, FIG. 6 to FIG. 9 are schematic diagrams of several structures of the receiving device 60 according to some embodiments of the present disclosure. The receiving device 60 is a hollow structure, which mainly supports and accommodates the structures and functional modules of the electric-pulse bullet 100. The interior of its casing 61 is mainly used for accommodating the circuit module 40 and other parts of the electric-pulse bullet 100. In the figure, it can be seen that the front of the receiving device 60 is provided with an electrode base 62, to store and fix the rear 23 of the electrode 21. The ejection device 30 is located at the front end of the receiving device 60. The ejection device 30 in the embodiment of FIG. 6 is an elastic entity, which can be made of rubber, elastic plastic, etc., while the ejection device 30 in the embodiments of FIG. 7 and FIG. 8 is an elastic-sheet structure, in the pop-up reset state. The ejection device 30 can be an independent structure separated from the receiving device 60 as shown in FIG. 6, or connected and fixed to the receiving device 60 by means of an extended fixing rod 67 in the front of the structure of the receiving device 60 as shown in FIG. 7 and FIG. 8. The ejection device 30 is provided with a U-shaped structure 31, which works together with the electrode base 62 to orient and hold each electrode 21 in an upright position to be launched, so as to prevent the electrode 21 from deflecting during storage or launching, and affect the ejection device 30 to play its ejection and separation role. The ejection device 30 can also adopt other suitable forms, such as a spring mechanism arranged on the body of the electrode 21 or the structure of the fixed rod 67. There is no intention to limit its scope here.

Figure 9:
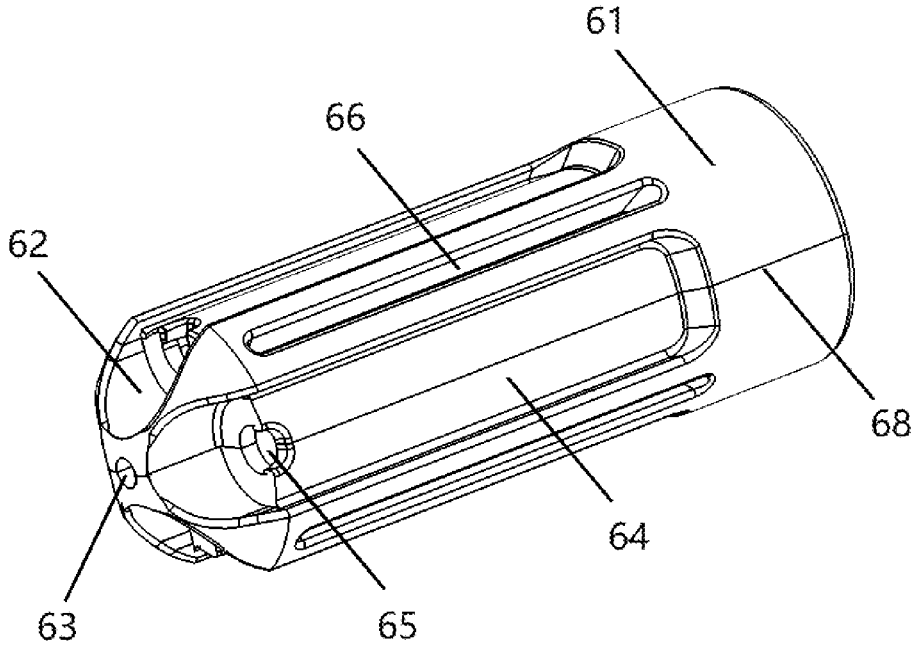

The front of the casing 61 of the receiving device 60 can be provided with wire hole 63, for the wire body 51 connecting the circuit module 40 to pass through. In the embodiments of FIG. 6, FIG. 7 and FIG. 8, four wire holes 63 are respectively provided for each wire body 51 of the connecting module 50 to be connected to an electrode 21 after passing through, while in the embodiment of FIG. 9, only one wire hole 63 is provided, all the connecting wire bodies 51 are respectively connected to each electrode 21 after passing through the hole. Another difference of the receiving device 60 shown in FIG. 9 is that its structure is two half shells, which are combined into a whole in the cartridge 10, accommodating the circuit module 40 therein. After launching, the receiving device 60 is divided into two along the division line 68, and separated and fall off from other structures of the electric-pulse bullet 100 as shown in FIG. 3, while the circuit module 40 disengages and continues to fly forward. The structure of the receiving device 60 in the figure can also be divided into multiple shells. For example, four shells are combined into a whole in the cartridge 10. The more the number of shells, the lighter the weight, the smaller the volume and body surface cross-sectional area, and the smaller the dynamic wind resistance. After being separated from each other, the receiving device 60 can also be connected to other structures, such as the circuit module 40 and dragged behind to undertake or enhance the role of the balancing device 70.

Figure 10:
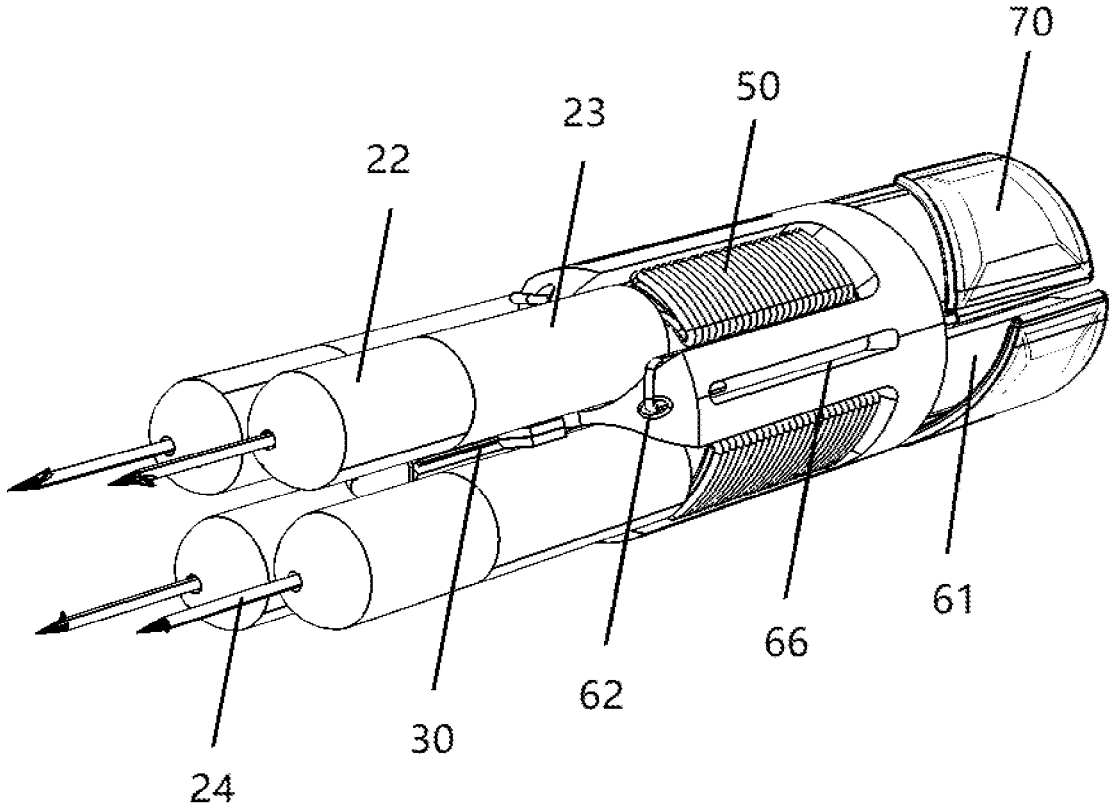
FIG. 10 is a structural diagram of the electric-pulse bullet inside the cartridge case according to an embodiment of the present disclosure.
Figure 11:
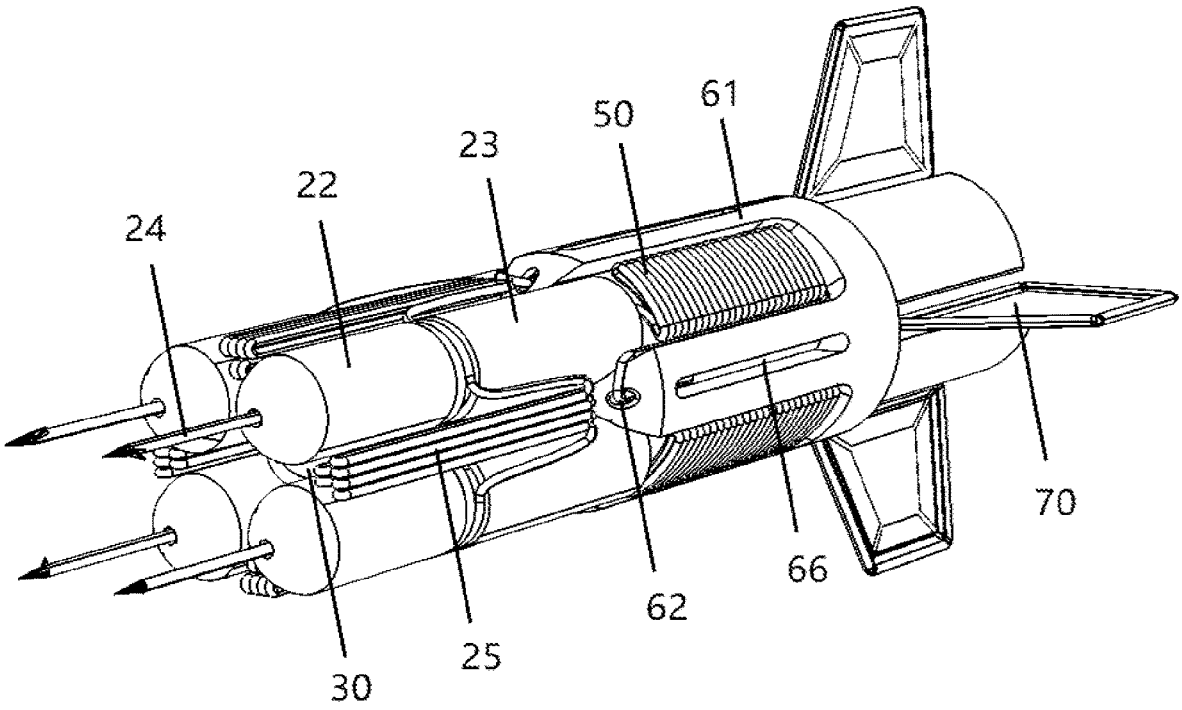
FIG. 11 is a structural diagram of the electric-pulse bullet inside the cartridge case according to another embodiment of the present disclosure.

As shown in FIG. 10 and FIG. 11, FIG. 10 and FIG. 11 are the static structural diagrams of the electric-pulse bullet 100 when it is inside the cartridge 10 according to two embodiments of the present disclosure. Here, the structure of each part of the electric-pulse bullet 100 has been set in place and is in a static state to be launched. In the figure, it can be seen that the wire body 51 is folded and stored between the wire storage groove 64 on the side wall of the receiving device 60 and the inner wall of the shell 11 of the cartridge 10. One end of the wire body 51 is connected with the output end of the circuit module 40 located inside the receiving device 60 and passes through the aperture 63, and the other end of the wire body 51 is connected with the rear 23 of the electrode 21 of the striking module 20. Both FIG. 9 and FIG. 10 include a balance tail 70, the balance tail 70 in FIG. 9 is in a folded state, and the balance tail 70 in FIG. 10 is in an unfolded state. The balance tail 70 can adopt different materials and processes, such as elastic engineering plastic sheet, or the metal material frame structure shown in the figure, which is padded and pasted with light film to form a solid plane, so as to reduce its weight as much as possible.

Different from the structure in FIG. 10, the embodiment in FIG. 11 also includes an elastic frame 24 structure, which is used to roughly fix and maintain the spacing of the electrodes 21 at one set length after the electric-pulse bullet 100 is launched, rather than the spacing of the electrodes 21 changes within a certain range with the shooting-range as in the previous embodiments. The spacing distance between the electrodes 21 can be preset according to the body contour features of different targets. For example, when used for human targets, the distance between the electrodes 21 is at least 100 millimeters, but not more than 600 millimeters. The entity of the elastic frame 24 can adopt different materials, such as fine metal wire or other non-conductive fiber wire. The materials need to have good elasticity and flexibility so that they can be folded in the cartridge 10, and stored in the gap formed between the two adjacent electrodes 21 and the inner wall of the shell 11 as shown in the figure. The basic structure of the elastic frame 24 is a closed approximate rectangular structure, and the four corner ends of the rectangle are respectively fixed on the electrode 21. In an embodiment, they are embedded and clip fixed between the front 22 and the rear 23 of the electrode, and are located at or as close to the center of gravity of the overall structure of the electrode 21 as possible. If the elastic frame is made of conductive material, insulation treatment shall be conducted at the contact areas with the electrode 21 to prevent short circuit between the electrodes 21 during use.

Figure 12:
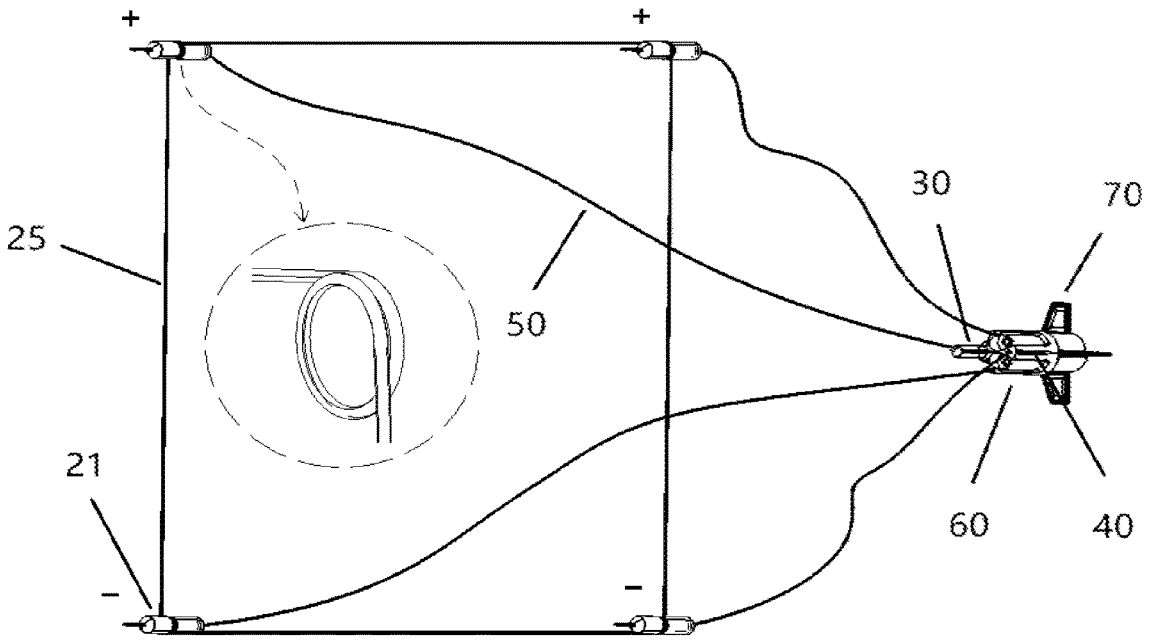
FIG. 12 is a schematic diagram of the dynamic structure of the electric-pulse bullet according to still another embodiment of the present disclosure during flight.

As shown in FIG. 12, FIG. 12 is a schematic diagram of the dynamic structural characteristics of the electric-pulse bullet 100 in flight in the embodiment of FIG. 11. In the figure, it can be seen that the elastic frame 25 is in the unfolded state. The launching principle and main dynamic characteristics of the electric-pulse bullet 100 shown in this embodiment are the same as those shown in FIG. 1 to FIG. 3. The difference is that when the electrodes 21 in the striking module 20 reach the preset separation spacing under the action of the ejection device 30, the elastic frame 25 maintains the preset spacing of the electrodes 21 in dynamic flight by relying on the restraint and elastic support of its own structure. The electric-pulse bullet 100 with this structural feature has the advantage that it can avoid the insufficient or excessive restraining effect of the connection module 50 on the electrode 21 due to structural error or other factors, such as the dynamic imbalance between the modules and the structures, resulting in too large or too small spacing between the electrodes 21, thereby affecting the accuracy and effect.

The above is only some embodiments of the present disclosure, which does not limit the scope of the present disclosure. Under the inventive concept of the present disclosure, the equivalent structural transformation made by using the contents of the description and attached drawings of the present disclosure, or directly/indirectly applied in other relevant technical fields, are included in the scope of the present disclosure.

What is claimed is:

1. An electric-pulse bullet, comprising: a striking module, comprising at least a pair of electrodes for launching to a target; an ejection device adjacent to the electrodes, configured to eject and separate the electrodes outwards when the electric-pulse bullet is launched, and causing a spacing between the electrodes immediately reach at least 100 millimeters; a circuit module, for generating pulse current, configured to fly lagging behind the electrodes; a connection module for electrically connecting the electrodes and the circuit module, and conducting the pulse current to the target through the electrodes; wherein a weight and/or a structure of the electric-pulse bullet are being preset, to form an orderly and balanced structure chain in flight, so as to curb excessive spreading of the electrodes and keep the spacing between the electrodes being within a range of 100 millimeters to 600 millimeters.

2. The electric-pulse bullet according to claim 1, wherein the spacing between the electrodes after the electrodes are ejected and separated is greater than that before being ejected and separated.

3. The electric-pulse bullet according to claim 2, wherein the spacing between the electrodes, after being ejected and separated, is 100-600 millimeters.

4. The electric-pulse bullet according to claim 1, wherein the connection module comprises at least one section of flexible wire body.

5. The electric-pulse bullet according to claim 4, wherein the wire body is a conductor.

6. The electric-pulse bullet according to claim 1, wherein the circuit module comprises a switch, and the switch is turned on after the electric-pulse bullet is launched, making the circuit module work and generate the pulse current.

7. The electric-pulse bullet according to claim 1, wherein the striking module comprises an elastic frame, and the elastic frame is arranged on the electrodes.

8. The electric-pulse bullet according to claim 7, wherein the elastic frame maintains the spacing between the electrodes at a preset length of 100-600 millimeters after the electrodes are ejected and separated.

9. A weapon, comprising the electric-pulse bullet according to claim 1.

10. The electric-pulse bullet according to claim 1, wherein at least a pair of electrodes separate along a sagittal plane in a flight direction.

11. A dynamic structure in flight of an electric-pulse bullet, wherein a weight and/or a structure of the electric-pulse bullet are being preset, comprising:

a striking module, comprising at least a pair of electrodes, the electrodes separate along a sagittal plane in a flight direction, and a spacing between the electrodes being at least 100 millimeters;

a circuit module, flying lagging behind the electrodes; and a connection module, connecting each electrodes to the circuit module respectively, and being stretched and tensioned, forming an elongated structure chain along the flight direction;

whereby limiting excessive separation of the electrodes and maintaining the spacing between the electrodes being within a range of 100 millimeters to 600 millimeters.

12. The dynamic structure in flight of the electric-pulse bullet according to claim 11, wherein the spacing between the electrodes, after being ejected and separated, is 100-600 millimeters.

13. The dynamic structure in flight of the electric-pulse bullet according to claim 11, wherein the connection module comprises at least one section of flexible wire body.

14. The dynamic structure in flight of the electric-pulse bullet according to claim 13, wherein the wire body is a conductor.

15. The dynamic structure in flight of the electric-pulse bullet according to claim 11, wherein the circuit module comprises a switch, and the switch is turned on after the electric-pulse bullet is launched, making the circuit module work and generate the pulse current.

16. The dynamic structure in flight of the electric-pulse bullet according to claim 11, wherein the striking module comprises an elastic frame, and the elastic frame is arranged on the electrodes.

17. The dynamic structure in flight of the electric-pulse bullet according to claim 16, wherein the elastic frame maintains the spacing between the electrodes at a preset length of 100-600 millimeters after the electrodes are ejected and separated.

18. A weapon, comprising the dynamic structure in flight of the electric-pulse bullet according to claim 11.

19. A method of launching an electronic pulse bullet towards a target, wherein a weigh and/or a structure of the bullet being preset to actively adjust a spacing of at least a pair of electrodes, the method comprising:

launching an electric-pulse bullet;

separating at least a pair of electrodes at a sagittal plane along the flight direction, wherein a spacing between the electrodes is at least 100 millimeters;

separating a circuit module from the electrodes and placing the circuit module to fly lagging behind the electrodes;

stretching and tensioning a connection module between each electrode and the circuit module to form an elongated structural chain along the flying direction;

adjusting a spacing between a pair of projectile to be within a range of 100-600 millimeters; and continuing to fly until hit a target with the electrodes covering a predetermined area on the target body.

* * * * *